US009696004B2

(12) United States Patent
Bobbo et al.

(10) Patent No.: US 9,696,004 B2
(45) Date of Patent: Jul. 4, 2017

(54) LIGHTING DEVICE AND CORRESPONDING METHOD

(71) Applicant: OSRAM GmbH, Munich (DE)

(72) Inventors: Simon Bobbo, Chirignago (IT); Alberto Alfier, Vedelago (IT); Simone Massaro, Venice (IT); Dina Pasqualini, Udine (IT); Marco Munarin, Paese (IT); Martin Reiss, Sinzing (DE)

(73) Assignee: OSRAM GmbH, Munich (DE)

( * ) Notice: Subject to any disclaimer, the term of this patent is extended or adjusted under 35 U.S.C. 154(b) by 7 days.

(21) Appl. No.: 14/864,961

(22) Filed: Sep. 25, 2015

(65) Prior Publication Data

US 2016/0091166 A1 Mar. 31, 2016

(30) Foreign Application Priority Data

Sep. 26, 2014 (IT) ..... TO2014A0767

(51) Int. Cl.

| | |
|---|---|
| ***F21V 3/04*** | (2006.01) |
| ***F21V 15/01*** | (2006.01) |
| ***F21K 99/00*** | (2016.01) |
| ***F21S 4/22*** | (2016.01) |
| ***F21K 9/00*** | (2016.01) |
| *F21V 31/00* | (2006.01) |
| *F21Y 103/10* | (2016.01) |
| *F21Y 115/10* | (2016.01) |

(52) U.S. Cl.

CPC ..... *F21V 3/0445* (2013.01); *F21K 9/00* (2013.01); *F21S 4/22* (2016.01); *F21V 15/012* (2013.01); *F21V 15/013* (2013.01); *F21V 31/005* (2013.01); *F21Y 2103/10* (2016.08); *F21Y 2115/10* (2016.08)

(58) Field of Classification Search

CPC ..... F21V 3/0445; F21V 15/012; F21K 9/00

See application file for complete search history.

(56) References Cited

FOREIGN PATENT DOCUMENTS

| | | | |
|---|---|---|---|
| DE | 102010061988 | A1 | 5/2012 |
| DE | 102012214484 | A1 | 2/2014 |
| EP | 2454520 | A1 | 5/2012 |
| EP | 2541288 | A1 | 1/2013 |
| WO | 2011110217 | A1 | 9/2011 |

OTHER PUBLICATIONS

Italian Search Report based on Application No. TO2014A000767 (8 Pages) dated May 22, 2015.

European Search Report based on Application No. EP 15 18 5716(8 Pages) dated Jan. 25, 2015.

*Primary Examiner* — Elmito Breval

(74) *Attorney, Agent, or Firm* — Viering, Jentschura & Partner mbB

(57) ABSTRACT

A lighting device, such as for example a LED flexible module, includes an elongated profiled body having a mouth portion, a first and a second lateral sides arranged sidewise of the mouth portion and a web side opposed the mouth portion. The profiled body includes a light-permeable portion, extending between the mouth portion and the first lateral side, and a light-impermeable portion extending between the second lateral side and the web side. A light radiation source assembly including a support member with one or more electrically powered light radiation sources is arranged at the mouth portion with the light radiation source(s) facing the light-permeable portion, whereby light radiation is directed towards the first lateral side for emission from the lighting device.

9 Claims, 2 Drawing Sheets

LIGHTING DEVICE AND CORRESPONDING METHOD

CROSS-REFERENCE TO RELATED APPLICATION

This application claims priority to Italian Patent Application Serial No. TO2014A000767, which was filed Sep. 26, 2014, and is incorporated herein by reference in its entirety.

TECHNICAL FIELD

Various embodiments may generally relate to lighting devices.

Various embodiments may refer to lighting devices employing solid state light radiation sources such as, for example, LED sources.

BACKGROUND

Lighting devices are available on the market comprising a flexible linear module in a protected version, wherein a light radiation source assembly (light "engine") is embedded in a case adapted to be implemented e.g. with polymer materials.

The case is adapted to protect the light radiation source assembly from the outer environment, without significantly affecting the performance thereof as regards light output performance.

A geometry that can be used to obtain such modules may be defined as an "up/down" geometry.

By adopting such a geometry, the light radiation source assembly (e.g. a support board such as a Printed Circuit Board or PCB, on which there are arranged electrically powered light radiation sources, such as LEDs) may be arranged horizontally in the case, the light radiation being emitted in the vertical direction. This geometry allows the module to be bent in the aforementioned up/down direction.

It is however more complex to achieve a sidewise flexibility, i.e. in a transversally of the previously described components. This problem may be dealt with, for example, by co-extruding the light radiation source assembly into a multiple components case, such as for example a central web, made of a partially diffusive polymer material, which is open on the upper side and has reflective walls on the sides and on the bottom, so as to direct the light radiation upwards, the PCB being arranged oriented vertically on one side.

Another possibility consists in laminating the light radiation source assembly, along one of the lateral walls, into a white channel-shaped U-profile, into which a partially diffusive polymer is subsequently dispensed.

These solutions may involve various drawbacks, such as the process complexity (which may affect both costs and process implementation) and the module appearance and performances.

SUMMARY

Various embodiments aim at overcoming such drawbacks.

According to various embodiments, said object is achieved thanks to a lighting device.

Various embodiments may also concern a corresponding method.

Various embodiments may achieve one or more of the following advantages:

a lighting device may be implemented as a linear module adapted to emit light in a direction perpendicular to the bending direction, in order to laminate the light radiation source assembly, an adhesive material may be used which acts as an interface material between the light radiation source assembly and the extruded profile, while improving the mechanical features of the extruded profile.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

In the following description, numerous specific details are given to provide a thorough understanding of one or more exemplary embodiments. The embodiments may be practiced without one or several specific details, or with other methods, components, materials, etc. In other instances, well-known structures, materials, or operations are not shown or described in detail to avoid obscuring various aspects of the embodiments. Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments, and/or may be associated to the embodiments in a different way from what is shown herein, so that e.g. a feature herein exemplified in connection to a Figure may be applied to one or more embodiments exemplified in a different Figure.

The headings provided herein are for convenience only, and therefore do not interpret the scope or meaning of the embodiments.

In the Figures, reference 10 denotes a lighting device adapted to be implemented, in one or more embodiments, as a linear, e.g. flexible, module, of a length which can be assumed as indefinite.

Device 10 is therefore shown in a cross-section which may be assumed as reproduced for at least a part of the length of device 10 itself. Such a device can therefore be implemented as a module which may be cut to length, even by the end user, so as to obtain a device having a size which matches the application conditions and/or requirements.

Figure 1:
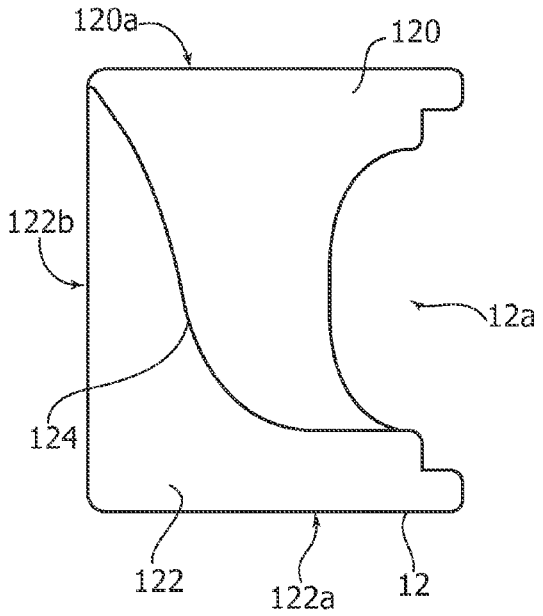
FIGS. 1 to 3 show, in an ideal cross-section, various steps for putting in practice embodiments, and FIGS. 4A to 4F exemplifies subsequent steps of a method according to various embodiments.

The cross-section view in FIG. 1 shows a profiled element 12 adapted to form the basic case structure of device 10.

In various embodiments, profiled element 12 seen as a whole may have a cross-section profile which is at least approximately channel-shaped, with a mouth portion 12*a*. Such a mouth portion faces rightwards in FIG. 1 and faces upwards in FIGS. 2 and 3.

In various embodiments, profiled element 12 may include (at least) two portions, which may be obtained for example via co-extrusion, including:

a first portion 120 of a light-permeable material (i.e. transparent), and a portion 122 of light-impermeable material (i.e. opaque).

Polymer materials adapted to have the described transparency/opaqueness features are currently available also for the implementation of lighting modules 10 structured as flexible modules.

Silicone is an example of polymer material which can be used in various embodiments, with the possibility to determine and regulate the degree of light permeability/non-permeability (transparency/opaqueness) by regulating the amount of a charge material, such as alumina.

In various embodiments, the light-impermeable (opaque) portion 122 may be used to direct light radiation towards light-permeable (transparent) portion 120.

The interface surface between portions 120 and 122 (exemplified in FIGS. 1 to 3 by line 124) may extend in a direction which may defined as an at least approximately diagonal direction with respect to the profile of element 12. The interface surface 124, moreover, may have a freely chosen profile, on the basis of the application needs described in the following.

As can be seen in FIG. 1 (and in FIGS. 2 and 3), transparent portion 120 envelops, at least for a substantial part, mouth part 12*a* of the profile and a first lateral wall 120*a*. The opaque portion 122, on the contrary, envelops the opposed lateral wall, denoted with 122*a*, as well as the bottom or web wall 122*b* of profiled element 12.

Figure 2:
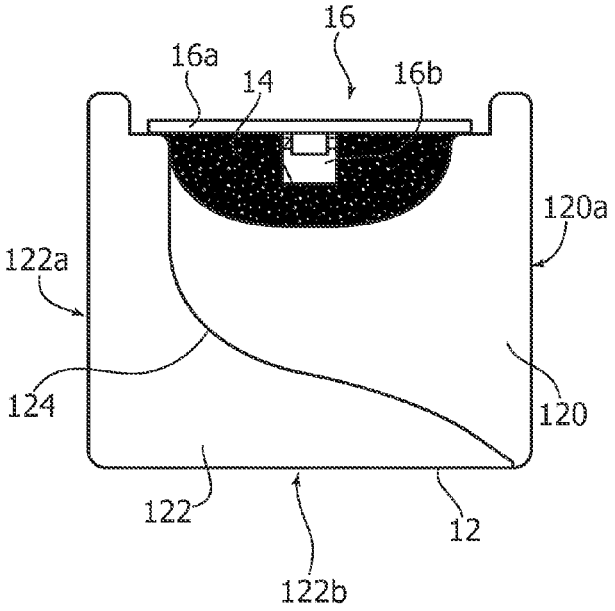
Figure 3:
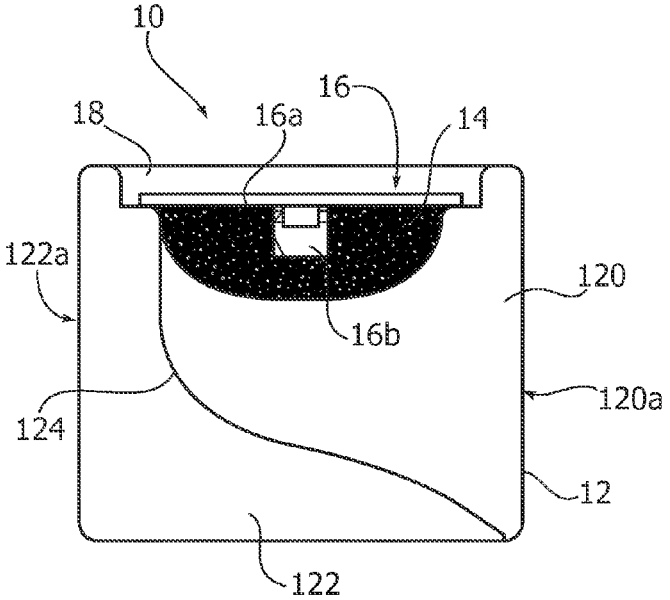

It will be appreciated that the relative position of portions 120 and 122 may be freely chosen, as exemplified in FIGS. 1 to 3, wherein in FIGS. 2 and 3 such a relative position is inverted as compared with the position shown in FIG. 1.

In various embodiments, in profile 12 there may therefore be available a wall or side where, as explained in the following, light radiation generation takes place (the wall or side exemplified herein by mouth portion 12*a*) and two mutually opposed sides 120*a*, 122*a* arranged sidewise of mouth portion 12*a* and adapted to act as walls or sides which "recycle" the light radiation generated at side or wall 12*a*.

FIG. 2 exemplifies the possibility of dispensing a light-permeable (i.e. transparent) material 14 (e.g. a glue or a potting mass, such as a polymer) within mouth portion 12*a*, and the possibility to apply, into such a mouth portion, a light radiation source assembly (e.g. by "laminating" it onto polymer 14, which again may consist of silicone).

In various embodiments, the light radiation source assembly may be of a kind known in itself, including:

a support board 16*a*, e.g. a Printed Circuit Board (PCB), and one or more electrically powered light radiation sources 16*b* applied on support 16*a*; in various embodiments these sources may be solid state light radiation sources, e.g. LED sources.

Moreover, FIGS. 2 and 3 highlight the fact that, in various embodiments, light radiation source assembly 16 may be mounted on profiled element 12, the light radiation sources 16*b* facing towards the inside of profiled element 12 itself.

The light radiation emitted by such sources propagates therefore through polymer 14, adapted to act as a fixation glue for assembly 16, and then through transparent polymer 120, so as to be emitted by device 10 from wall or side 120*a*.

In various embodiments, interface surface 124 may be implemented/processed (e.g. through a process of aluminium coating) in such a way as to act as a reflective surface, in order to enhance such an orientation effect of the light radiation.

FIG. 3 exemplifies the possibility to apply a further layer 18, e.g. of a polymer material, adjacent support board 16*a* (on the outer side, i.e. on the face opposed to where light radiation sources 16*b* are mounted), adapted to seal the case of device 10 while imparting it protection features from outer agents (e.g. an IP protection grade).

A device (module) 10 as exemplified in FIG. 3 may be bent vertically (i.e. in the up/down direction with respect to the orientation shown in FIG. 3), the light radiation being adapted to be emitted "sidewise" from side 120*a*.

The opaque material of portion 122 is adapted to block the light radiation emission at the other side 122*a* and at web side 122*b*, while light radiation assembly 16 blocks the light radiation emission from the further side of profiled element, corresponding to mouth portion 12*a* of the channel-shaped profile.

For example, the result which may be obtained is that a part of the radiation emitted by the radiation source assembly 16 is emitted directly through side 120*a*, while the remaining part impinges on surface 124 (which e.g. is made optically reflective/diffusive and is shaped to this end) in order to be directed towards side 120*a*.

FIGS. 4A to 4F exemplify a possible production process corresponding to the foregoing description.

Figure 4A:
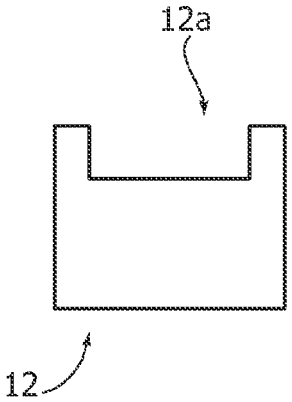
Figure 4B:
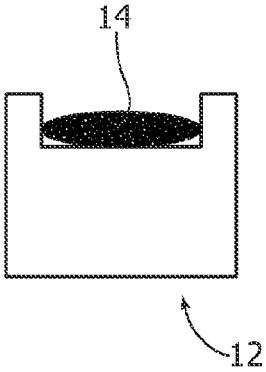
Figure 4C:
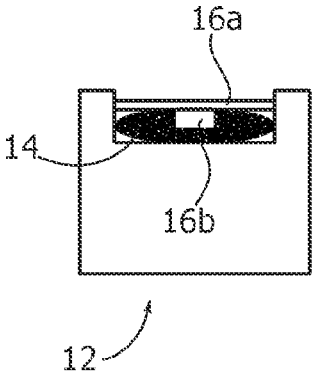
Figure 4D:
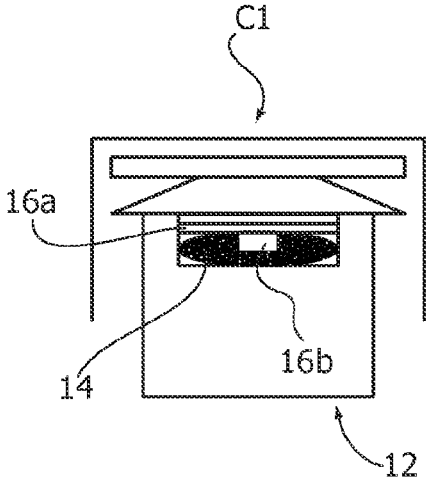
Figure 4E:
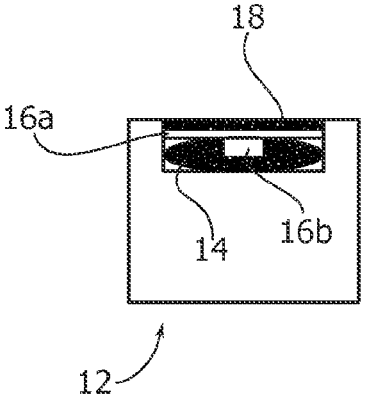
Figure 4F:
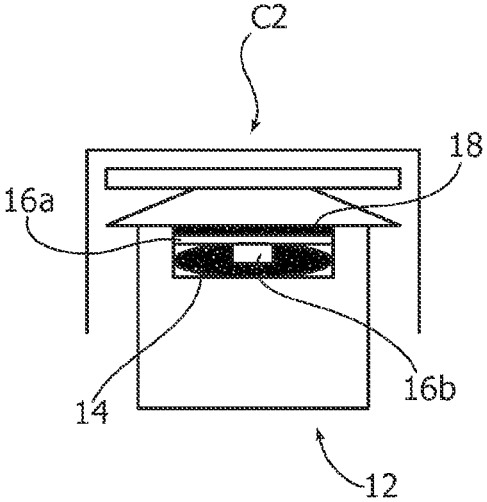

In detail, FIGS. 4A to 4F exemplify the following steps:

FIG. 4A: producing (for example by co-extrusion) profiled element 12, as shown in FIG. 1, FIG. 4B: dispensing polymer 14 (adapted to act as an assembling glue), FIG. 4C: mounting (laminating) light radiation emitting assembly 16, FIG. 4D: curing layer 14, FIG. 4E: dispensing sealing layer 18, and FIG. 4F: curing sealing layer 18.

In various embodiments, a single curing step may be provided for both layers 14 and 18, with the possibility to skip the step shown in FIG. 4D.

In various embodiments, the light-permeable portion (e.g. denoted by 120) may include a material having diffusivity features, so as to create a light radiation distribution which appears homogeneous, and therefore diffused, even when it is observed closely.

As previously mentioned, in various embodiments the material of transparent portion 120 may be silicone, such a material being adapted to form opaque portion 122 as well, if it is charged with a percentage (for example 10%) of alumina ($Al_2O_3$) particles.

In various embodiments, the same solution (with a lower charge content, e.g. 0.5%) may be used in order to obtain a transparent portion 122 with diffusivity features.

It will be moreover appreciated that the approximately square section of body 12 exemplified herein is not a mandatory feature: in one or more embodiments body 12 may actually have a different profile section, e.g. a higher or lower rectangle, a circle, a mixtilinear shape, etc.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device, comprising:

an elongated profiled body having a mouth portion, a first and a second lateral sides sidewise of said mouth portion and a web side opposed said mouth portion, said profiled body including a light-permeable portion extending between said mouth portion and said first lateral side and a light-impermeable portion extending between said second lateral side and said web side, and a light radiation source assembly including a support member with at least one electrically powered light radiation source, said light radiation source assembly arranged at said mouth portion with said at least one light radiation source facing said light-permeable portion, whereby light radiation from said at least one light radiation source is directed towards said first lateral side for emission from the lighting device, wherein said profiled body and said light radiation source assembly are flexible, and wherein the lighting device comprises a mounting layer of a light-permeable material for mounting said light radiation source assembly at said mouth portion and a sealing layer applied onto said light radiation source assembly at said mouth portion opposed said at least one light radiation source.

2. The lighting device of claim 1, wherein said profiled body is channel-shaped with said web side being the bottom side of the channel shape.

3. The lighting device of claim 1, further comprising a separation surface of said light-permeable portion and said light-impermeable portion, said separation surface extending diagonally of said profiled body.

4. The lighting device of claim 1, wherein said light-permeable portion and said light-impermeable portion include a polymer material.

5. The lighting device of claim 1, wherein said light-permeable portion is of a light diffusive material.

6. The lighting device of claim 1, wherein said light permeable portion and said light-impermeable portion include a same material charged with different levels of a charge material.

7. The lighting device of claim 1, wherein said at least one light radiation source is a solid state light radiation source.

8. A method of producing a lighting device, comprising:

providing an elongated profiled body having a mouth portion, a first and a second lateral sides sidewise of said mouth portion and a web side opposed said mouth portion, said profiled body including a light-permeable portion extending between said mouth portion and said first lateral side and a light-impermeable portion extending between said second lateral side and said web side, arranging at said mouth portion a light radiation source assembly including a support member with at least one electrically powered light radiation source, with said at least one light radiation source facing said light-permeable portion, whereby light radiation from said at least one light radiation source is directed towards said first lateral side for emission from the lighting device, and providing a mounting layer of a light permeable material for mounting said light radiation source assembly at said mouth portion and a sealing layer applied onto said light radiation source assembly at said mouth portion opposed said at least one light radiation source.

9. A lighting device, comprising:

an elongated profiled body having a mouth portion, a first and a second lateral sides sidewise of said mouth portion and a web side opposed said mouth portion, said profiled body including a light-permeable portion extending between said mouth portion and said first lateral side and a light-impermeable portion extending between said second lateral side and said web side, and wherein the elongated profiled body comprises a separation surface of said light-permeable portion and said light-impermeable portion, said separation surface extending diagonally of said profiled body, a light radiation source assembly including a support member with at least one electrically powered light radiation source, said light radiation source assembly arranged at said mouth portion with said at least one light radiation source facing said light-permeable portion, whereby light radiation from said at least one light radiation source is directed towards said first lateral side for emission from the lighting device.

* * * * *